US009107789B2

(12) United States Patent
Brandorff et al.

(10) Patent No.: US 9,107,789 B2
(45) Date of Patent: Aug. 18, 2015

(54) INVALID TOILETING SAFETY SLING

(71) Applicants: Alexander Brandorff, New Milford, CT (US); Catherine Susan Brandorff, New Milford, CT (US)

(72) Inventors: Alexander Brandorff, New Milford, CT (US); Catherine Susan Brandorff, New Milford, CT (US)

( * ) Notice: Subject to any disclaimer, the term of this patent is extended or adjusted under 35 U.S.C. 154(b) by 152 days.

(21) Appl. No.: 13/975,348

(22) Filed: Aug. 25, 2013

(65) Prior Publication Data

US 2015/0052680 A1 Feb. 26, 2015

Related U.S. Application Data

(60) Provisional application No. 61/693,259, filed on Aug. 25, 2012.

(51) Int. Cl.
*A61G 7/10* (2006.01)
*A61G 7/02* (2006.01)

(52) U.S. Cl.
CPC ..... *A61G 7/1073* (2013.01); *A61G 7/1051* (2013.01); *A61G 7/02* (2013.01); *A61G 2200/34* (2013.01)

(58) Field of Classification Search
CPC ..... A61G 7/1051–7/1073; A61G 7/02; A61G 2200/34
USPC ..... 5/89.1, 81.1 R, 81.1 HS, 83.1, 87.1
See application file for complete search history.

(56) References Cited

U.S. PATENT DOCUMENTS

| | | | | |
|---|---|---|---|---|
| 6,289,534 | B1 * | 9/2001 | Hakamiun et al. | 5/89.1 |
| 8,250,685 | B1 * | 8/2012 | Kocet | 5/81.1 T |
| 8,566,977 | B2 * | 10/2013 | Davis | 5/81.1 HS |
| 2006/0080775 | A1 * | 4/2006 | McWattie et al. | 5/89.1 |
| 2013/0152304 | A1 * | 6/2013 | Dovervik et al. | 5/89.1 |

* cited by examiner

*Primary Examiner* — Peter M Cuomo
*Assistant Examiner* — Brittany Wilson
(74) *Attorney, Agent, or Firm* — Luis Figarella

(57) ABSTRACT

An improved patient transfer and toileting sling comprising an additional flap 3 fabric and adjustment strap 4. The additional fabric and adjusting means allows for enhanced security during transfers and can be easily and quickly removed to facilitate access to patient's clothing during toileting. Adjustment buckles 6 allow the sling to be secured and fitted around a patient's bottom for enhanced comfort and security during transfers. They can also be used to secure the additional flap 3 fabric up and out of the way during toileting to allow for improved access to a patient's clothing.

12 Claims, 8 Drawing Sheets

FIG. 2
(PRIOR ART)

INVALID TOILETING SAFETY SLING

This application claims the benefit of Provisional Patent Application 61/693,259 filed Aug. 25, 2012.

BACKGROUND

1. Field of Invention

This invention relates to disabled patient lifting slings used with mechanical patient lifts, specifically to such slings used for toileting.

2. Description of Prior Art

Slings used for toileting of disabled individuals, commonly referred to as "split" slings, often consist of a generally U-shaped fabric, as shown in FIG. 1. Referring to FIG. 1, the conventional split sling 1 is a substantially U-shaped fabric comprising a central span 2 that serves as a back support section and substantially vertical fabric 8 extending from either side of the central span and substantially perpendicularly to the central span. The vertical fabric 8 is placed under the thighs of the patient and comes up between the legs of the patient, as illustrated in FIGS. 2 & 3. Referring to FIGS. 2 & 3, leg straps 11 extend from the ends of vertical fabric 8 and connect to a lifting device 13. The purpose of the sling is to provide a safe and secure means of transferring a disabled individual to a toilet, while also providing access for lowering clothing so that toileting can be effected. These two primary purposes of the sling are to some degree conflicting as will be explained below. It is also desirable to be able to place the sling on someone who is already sitting in a wheelchair without having to first raise the person out of the chair to place the sling underneath them.

To effect toileting, which requires partial removal of clothing, it is desirable to maximize access to the persons' clothing by leaving their buttocks area maximally exposed and accessible. However this is in conflict with the need to transfer them safely and securely from a wheelchair to the toilet, since the larger the opening in the sling to provide access to clothing, the less support the sling provides and the greater the tendency for a patient to slide through the sling, as illustrated in FIG. 4. In addition, the large variation in body shapes and sizes among the disabled patient population requires that there be a range of sling sizes available to accommodate this variation. An individual patient may therefore be assigned a sling that is not optimally sized for them specifically, which may further increase the tendency to slide through the sling or alternatively may not provide sufficient access to clothing. The need to stock a wide variety of sling sizes is also an added cost for health care facilities. The need to select a sling for an individual patient creates an opportunity for an incorrect selection to be made, increasing the risk to the patient. In addition, since toileting is after time-sensitive, it is necessary to be able to place the sling and effect the transfer in a minimum amount of time.

While this field contains considerable prior art, these slings have proven inadequate. U.S. Pat. No. 7,624,458 B2 to Felling describes a conventional "split" transfer sling design. While this design of split sling does provide increased support underneath the patient's buttocks to minimize the tendency for the patient to slide through the sling, the opening in this type of sling does not provide sufficient access to clothing to effect lowering/removal of the clothing for toileting.

U.S. Pat. No. 6,289,534 B1 to Hakamiun and U.S. Pat. No. 5,530,975 A to Firebaugh show a lift using a similar conventional "split" transfer sling with insufficient access to clothing.

U.S. Pat. No. 6,883,190 B2 to Carbonneau presents a variation on a "split" sling with additional patient securing means, but it also does not provide for clothing accessibility.

U.S. Pat. No. D602224 S1 to Liljedahl describes a conventional "split" toileting sling. The opening in this sling is enlarged to allow the patient's buttocks to protrude through the sling and allow better access to the patient's clothing. Great care must be used however to prevent the patient from slipping through the sling. The sling must therefore be sized and carefully adjusted to the individual patient, requiring additional time and a well trained nursing staff. Even so, patients with poor body tone tend to slip through the opening.

U.S. Pat. No. 5,530,975 A to Hickerson attempts to improve the access to clothing by using a support strap just behind the knees and a support strap which is cinched around the patient's waist along with supports underneath the armpits to prevent the patient from sliding down. While providing good access to clothing, this sling design is uncomfortable and impractical for a wide variety of patients, particularly those without good muscle tone. U.S. Pat. No. 6,578,210 B2 to Erickson describes a similar two-piece sling. It also concentrates the lifting force on relatively small areas and is therefore uncomfortable and only suitable for individuals with good muscle tone.

U.S. Pat. No. 4,944,057 A to Shaw is typical of solid-bottomed slings with an aperture to facilitate toileting. While these address the issue of the tendency of patients to slide through conventional "split" toileting slings, they do not provide access to clothing.

U.S. Pat. No. 7,945,975 B2 to Clifford and U.S. Pat. No. 6,122,778 A to Cohen describe vests worn by a patient having handholds for lifting a patient. This approach requires the patient to wear an additional garment of clothing of the appropriate size.

U.S. Pat. No. 8,214,945 B2 to Simon and U.S. Pat. No. 5,355,538 A to Fulford describe complicated and expensive mechanical frames that are fitted to an individual and then connected to a lifting apparatus. The rigid design presents difficulty in terms of initially placing the patient in the fixture.

U.S. Pat. No. 6,192,534 B1 to Restivo and U.S. Pat. No. 7,287,288 B2 to Simon use a frame with pads to squeeze the patient's sides underneath the arm pits and leg supports behind the knees.

The design is not suitable for patients with breathing difficulties.

U.S. Pat. No. 4,435,863 to Lerich describes a transporting device consisting of a pivoting chest pad to which the patient is strapped. The patient is transferred in a bent-over orientation and pivoted down onto a receiving surface. The design results in part of the weight being carried on the patient's chest, making it inappropriate for patients with breathing difficulties, who use ventilators or who wear cervical spine stabilization devices.

U.S. Pat. No. 6,581,222 B1 to Liljedahl describe a back support sling used with standing aid lifters. These do offer good clothing access but are not suitable for amputees or individuals who can not bear weight on their legs.

Objects and Advantages

Accordingly, several objects and advantages of the present invention are:

- to provide a sling that can be easily and quickly applied;
- to provide a sling which minimizes the tendency for patients to slide through the sling opening during transfer;

to provide a sling which affords easy access to clothing for toileting;

to provide a sling which maximizes comfort by distributing the patient's weight over a large area;

to provide a sling that is adaptable to a wide variety of body sizes;

to provide a sling that can be used for a wide variety of patients and medical conditions.

to provide a single sling that can be easily configured for both transfers and toileting

REFERENCE NUMERALS IN DRAWINGS

Figure 1:
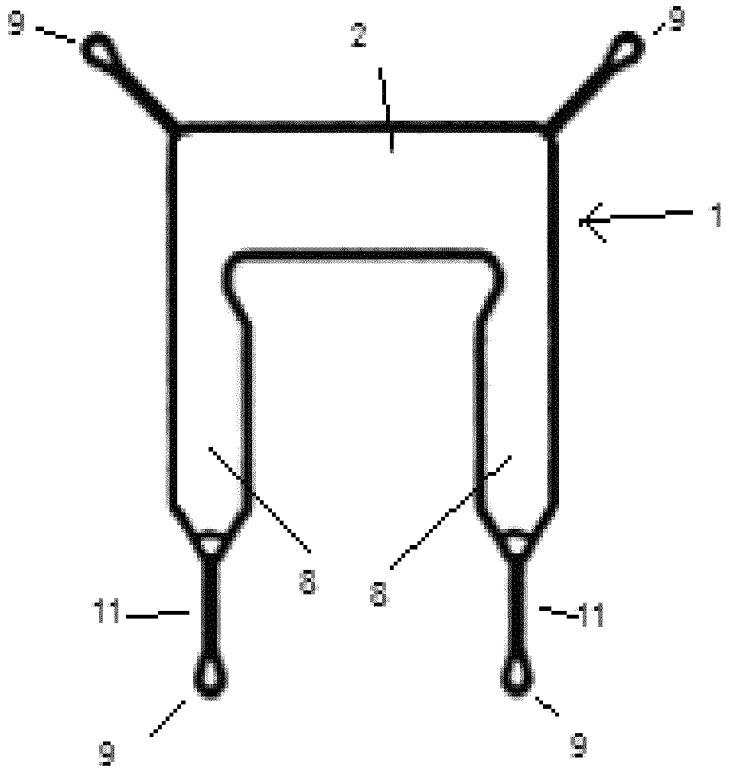
FIG. 1 (PRIOR ART)
FIG. 1 is a plan view of a conventional "split" toileting sling
Figure 2:
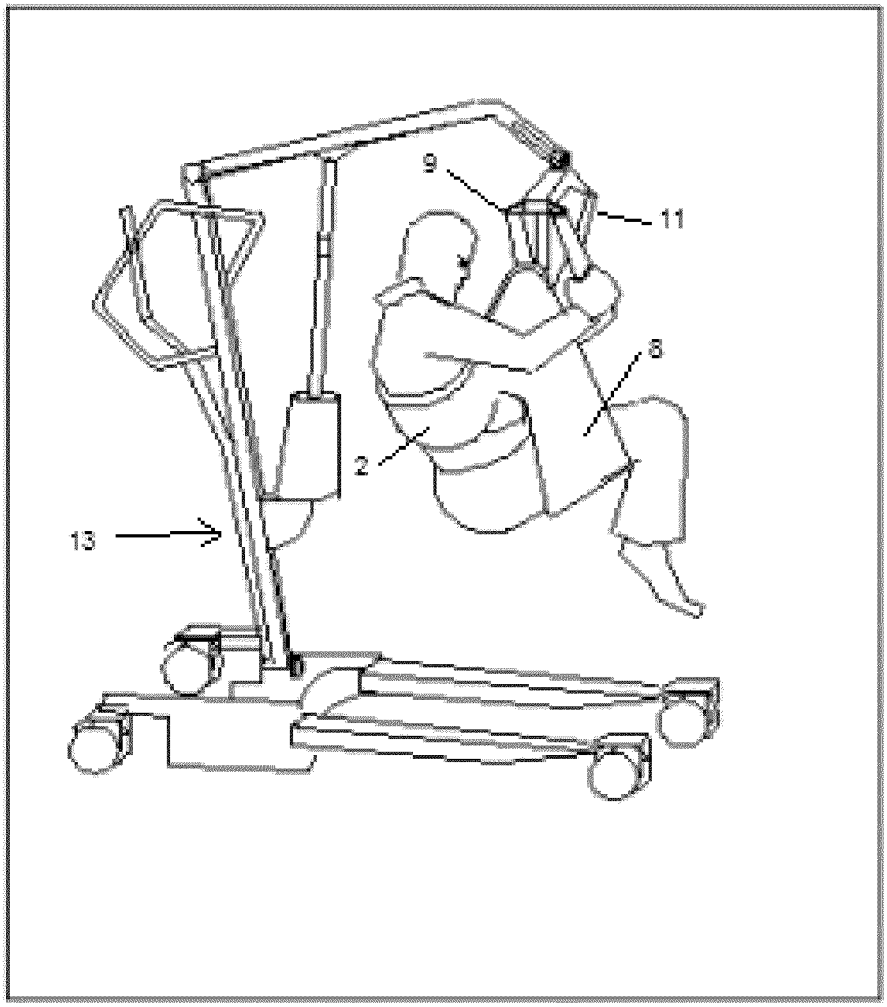
FIGS. 2 & 3 are perspective views of conventional "split" toileting slings in use
Figure 3:
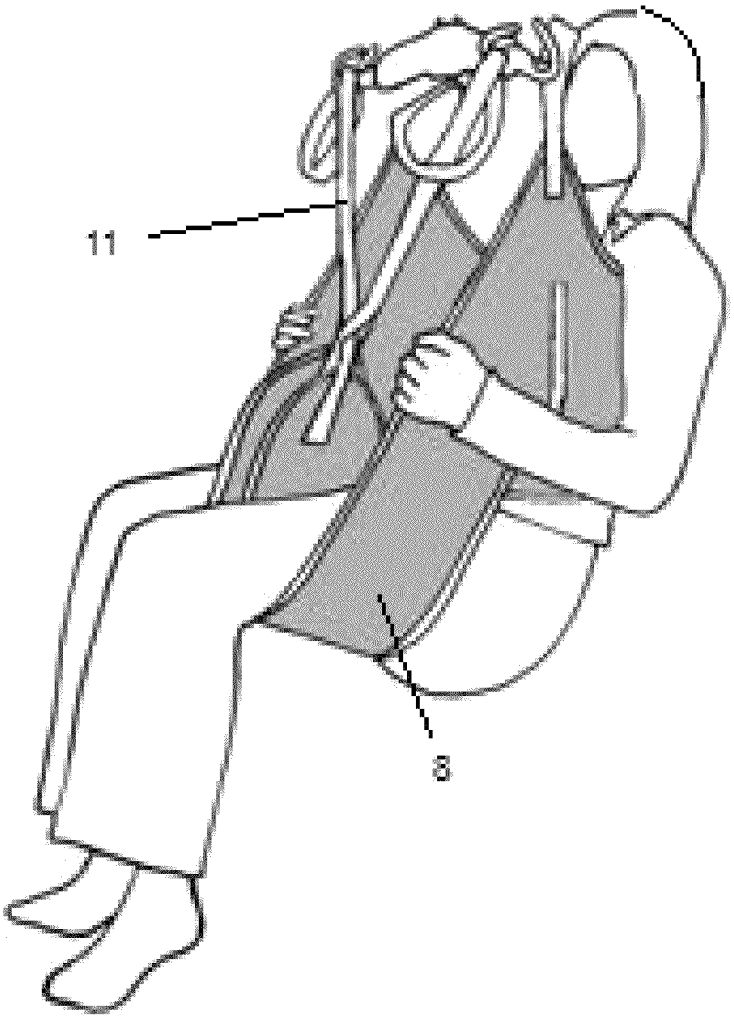
FIG. 3 (PRIOR ART)
Figure 4:
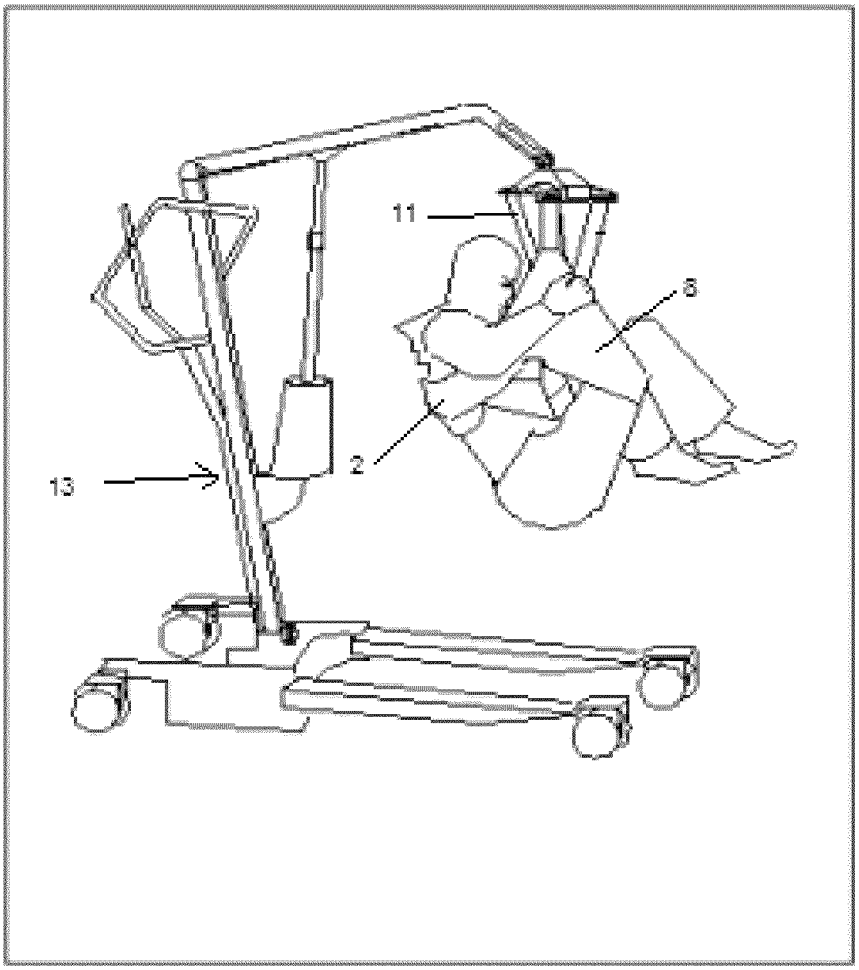
FIG. 4 is a perspective view showing a patient sliding through the opening in a conventional "split" toileting sling

1 Sling
2 Back-support horizontal span
3 Security flap
4 Strap
5 Ring
6 Adjustment buckle
7 Free end of strap
8 Thigh-support vertical fabric
9 Connectors
10 Edge of flap 3 where strap is sewn
11 Leg straps
12 Pouch formed when security flap 3 is folded back
13 Lifting device
14 Toilet

SUMMARY

In accordance with the present invention a simple toileting sling that is easily applied, simple to use, provides enhanced safety during transfers and enhanced access to clothing during toileting, is economical and that transfers the patient in a dignified and comfortable manner and is suitable for a wide variety of patients.

Description of Preferred Embodiment

FIG. 5

Figure 5:
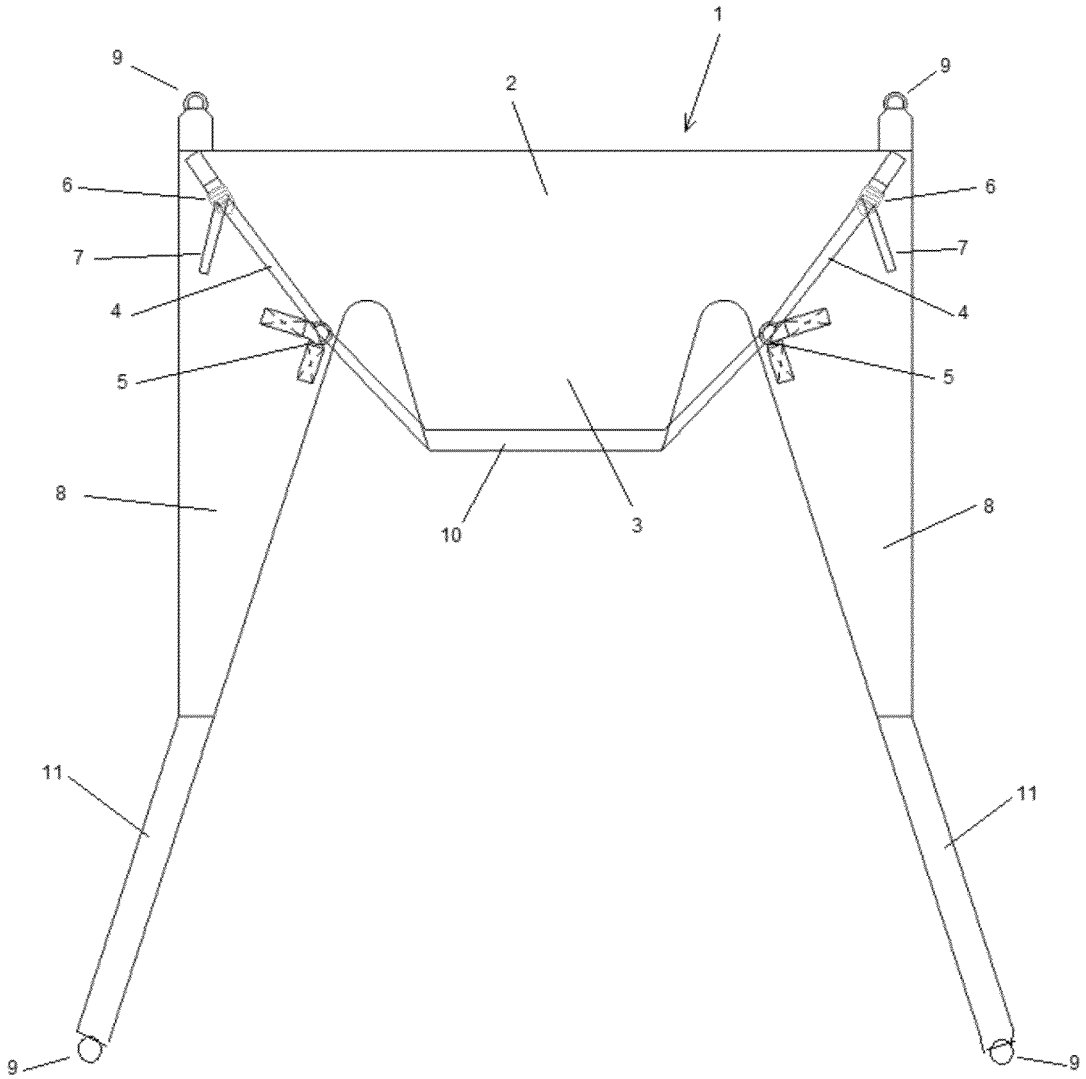
FIG. 5 is a plan view of the invention

FIG. 5 shows a plan view of the preferred embodiment of the invention. The proposed toileting sling 1 is a substantially U-shaped fabric comprising a central span 2 that serves as a back support section and substantially vertical fabric 8 extending from either side of the central span and substantially perpendicularly to the central span that serve as thigh support sections. In the preferred embodiment, the fabric is a flexible nylon. However the fabric can consist of any other flexible material or open-weave mesh material. The toileting sling 1 also incorporates a flap 3 of fabric, which extends down from the base of the back-support horizontal span 2 of the sling. A strap 4 is sewn along the bottom edge 10 of the flap 3. Each end of the strap 4 passes through a ring 5 sewn onto the side of the sling, and then through adjustment buckles 6 at the top of the sling 1. In the preferred embodiment the adjustment buckles 6 are attached at a support point located near the top of the sling. In the preferred embodiment the ring 5 is a metal O-ring of approximately 1" diameter, the strap 4 is a nylon strap of approximately 1" width and 0.1" thickness, and the adjustment buckles 6 are metal. However the ring 5 may be made of other materials including plastics and may be of another shape, such as triangular, square, etc. or of a different size. Similarly the strap 4 may be made of alternative materials or have a different width or cross-sectional shape. The adjustment buckles 6 may also be made of other materials including plastics. Other adjustment mechanisms are also possible. Rather than buckles, the adjustment may be performed using hooks, eyelets, ratchets, etc. Leg straps 11 extend from the ends of the thigh support vertical fabric 8. Connectors 9 at the corners of the back support span 2, and at the ends of the leg straps 11, serve as attachment points to a patient lifting device. In the preferred embodiment the connectors 9 are round metal O-rings, but other attachment mechanisms are possible such as hooks, eyelets, adjustment buckles, etc.

From the description above, a number of advantages of our Invalid Toileting Safety Sling become evident. This invention provides a toileting sling design which minimizes the tendency for patients to slide through the sling during transferring, while also providing maximum access to clothing for toileting. It is therefore possible to effect both secure transfers and toileting with only one sling whereas having both a transfer and a toileting sling is now often necessary. A further purpose of this invention is to provide a degree of adjust ability in order to minimize the number of different sling sizes required and to provide a better fit for an individual patient. The additional flap 3 fabric can be tucked underneath the patient's bottom while sitting in a wheelchair. The flap 3 fabric thereby provides additional support underneath the patient during transfers for improved safety and comfort. The adjustment buckle 6 is placed at an accessible location for an attendant, and the adjustment straps 4 can be tightened by pulling on the free ends 7 of the adjustment straps 4. Tightening the adjustment straps 4 pulls the flap 3 fabric taut around the patient's bottom. The flap 3 fabric thereby provides additional support for the patient, effectively closing the opening in the sling during transport and greatly reducing the tendency to slide through the sling. The sling is thereby "fitted" to the patient. Once the transfer from the wheelchair to the toilet is effected, the adjustment straps 4 can be loosened and the flap 3 fabric raised to provide maximal access to clothing.

Operation of Preferred Embodiment

FIGS. 5, 6, 7, 8

Figure 6:
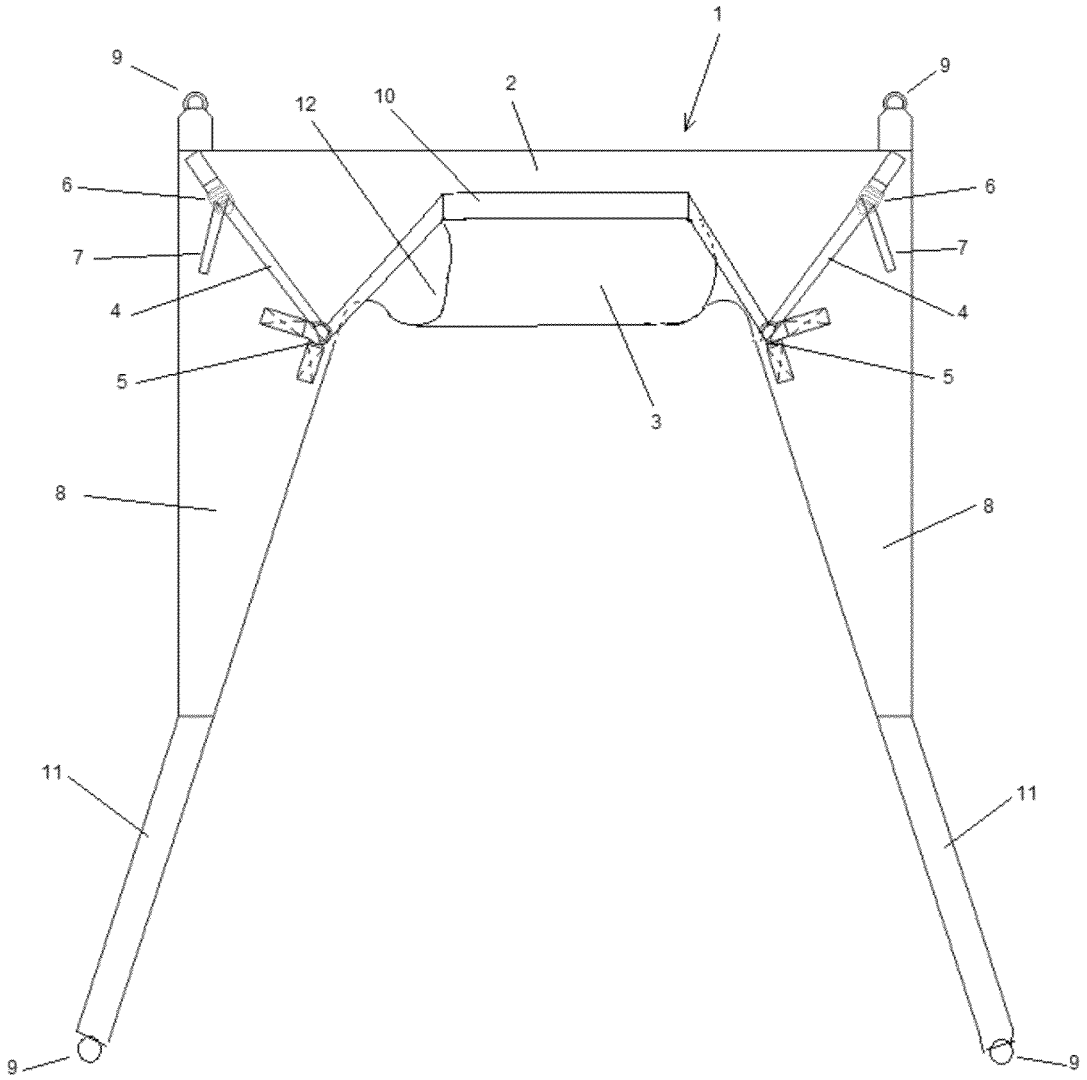
FIG. 6 is a plan view of the invention
Figure 7:
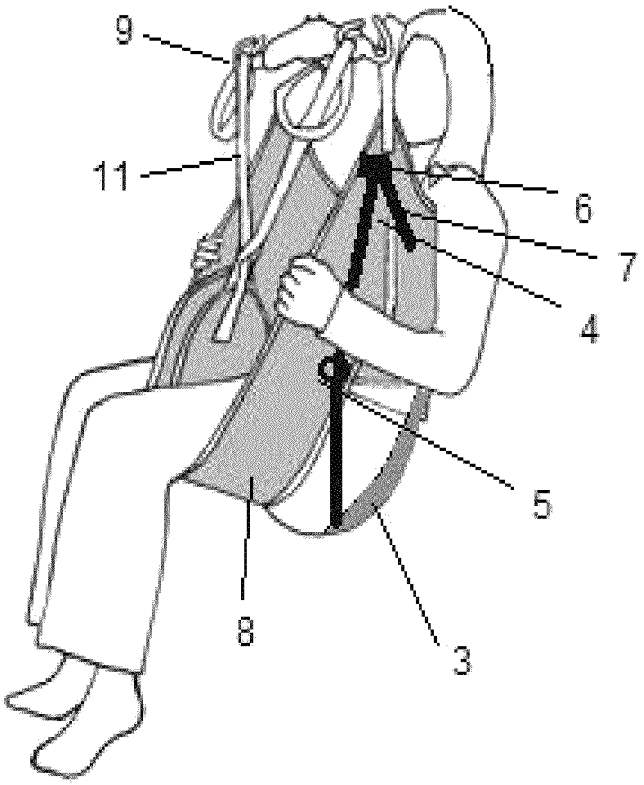
FIG. 7 is a perspective view of the invention in use during transfers
Figure 8:
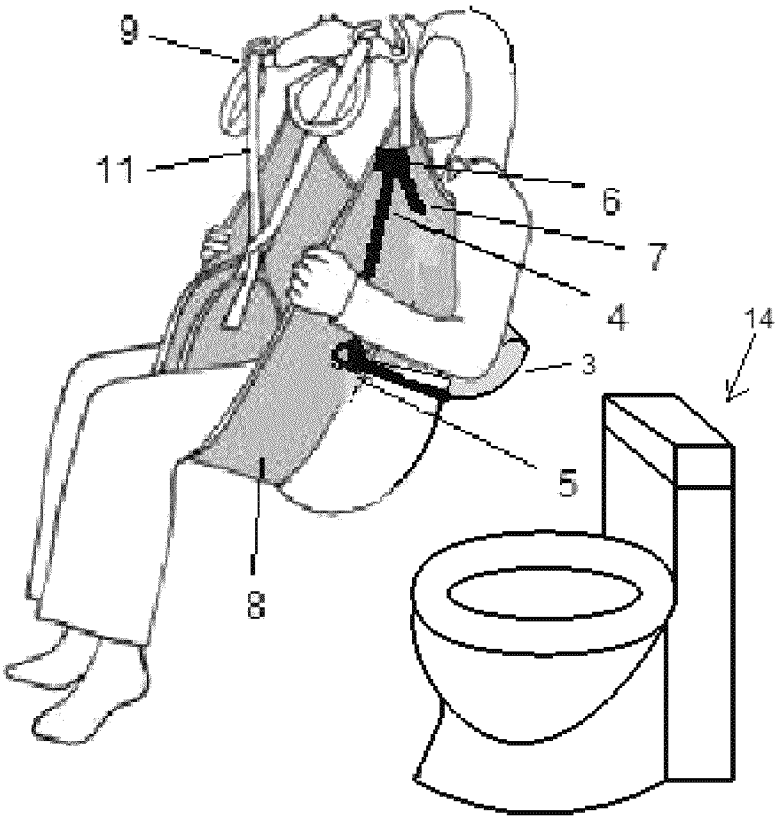
FIG. 8 is a perspective view of the invention in use during toileting

Use of the proposed toileting sling will be explained in the context of transferring a disabled individual (referred to here as a "patient") from a wheelchair to a toilet by a health care provider (referred to here as an "attendant"). While the sling can be used to move the patient to and from various locations, the examples used here is the patient is initially seated in a wheelchair and the desired location is a commode or toilet. The attendant begins by sliding the back support span 2 of the sling 1 down behind the back of the patient who is seated in a wheelchair. Referring now to FIG. 6, to facilitate sliding the sling 1 behind the back, the flap 3 fabric is folded back onto the back support span 2 of the sling, creating a pouch 12 into which the attendant slides her hands while positioning the sling. This pouch 12 facilitates the process of sliding the sling down behind the back of the patient. Having slid the sling down until the bottom edge of the back-support span 2 is approximately at the patient's waist level, the attendant can then use her hands to unfurl said pouch 12 so as to roll it partly under the patient's bottom. The attendant then places the thigh support vertical fabric 8 under each of the patient's thighs so that the fabric comes up between the legs. Referring now to FIG. 7, the sling 1 can now be connected to the lifting device to be used, as is done with a conventional toileting sling. Once the sling is firmly attached to the lifting device, the attendant lastly tugs on the free ends 7 of the adjustment straps 4 to wrap and snug the flap 3 fabric to the patient's bottom. The patient can now be raised from his wheelchair and securely and safely transferred to the toilet. Referring now to FIG. 8, with the patient now suspended a few inches above the toilet, the attendant loosens the adjustment straps 4 and pulls back the flap 3 fabric. Gently re-tightening the adjustment straps 4 secures the flap 3 fabric up and out of the way of the clothing. The attendant now removes/lowers the clothing and then lowers the patient down onto the toilet 14. Once toileting is complete the process is reversed. The attendant raises the patient a few inches off the toilet 14, cleans up and raises the clothing. She then lowers the flap 3 fabric around the person's bottom, snugs up the adjustment straps 4 and transfers the patient securely back to the wheelchair.

While the proposed sling is ideally suited for toileting, it is understood that the sling can also be used to effect transferring patients safely between various surfaces, such as to/from a bed and a wheelchair, to/from a wheelchair and a car, etc.

Alternative Embodiments

The preferred embodiment of the sling illustrated in FIGS. 5 through 8 can be altered in a variety of ways without changing the scope of the invention. For example the flap 3 fabric can be made separable from the main body of the sling, the adjustment straps 4 can be secured differently or placed in a casing so as to freely slide along the sling rather than being sewn in place, the adjustment buckles 6 may be secured to a support point on a lifting device used in combination with the sling rather than to the sling itself, different types of adjustment buckles 6 and connections 9 may be used, the adjustment buckles 6 may be replaced by hooks, eyelets, etc. The above mentioned alternative embodiments illustrate that various aspects of the sling can be changed without changing the scope of the invention. Many different configurations of the sling are possible, and the variations mentioned above are not intended to be all-inclusive.

SUMMARY, RAMIFICATIONS, AND SCOPE

Accordingly, the reader will see that the invalid toileting safety sling of this invention can be used to transfer patients in a comfortable and secure manner, while also providing access to clothing to facilitate toileting. Additional advantages of this invention are its ease of use, faster transfer time, and reduced level of training required.

Although the description above contains many specificities, these should not be construed as limiting the scope of the invention but as merely providing illustrations of some of the presently preferred embodiments of this invention. Many other variations are possible. For example, the thigh support vertical fabric 8 can be made separable from the back support horizontal span 2 and flap 3 fabric portions of the sling; the length of the flap 3 fabric can be made longer or shorter; the rings 5 can have other shapes, such as oval, triangular, trapezoidal, etc.; the flap 3 fabric can have other shapes, etc.

A variety of patient lifting means can be used in conjunction with the sling. Various types of upper-body supporting means could also be incorporated, such as chest support straps or supports for under a patient's armpits. The number, locations, and nature of the sling connectors 9 can also be changed in alternative embodiments.

Thus the scope of the invention should be determined by the appended claims and their legal equivalents, rather than by the examples given.

What is claimed is:

1. A patient sling comprising:

a) a substantially u-shaped fabric comprising a horizontal central span and a substantially vertical fabric extending from either side of said central span and substantially perpendicularly to said central span;

b) a flap of fabric extending downwards from said central span and between said vertical fabric;

c) a plurality of connecting means for securing said sling to a lifting and transporting device;

d) at least one strap attached to said flap and extending outwards from either side of said flap, the ends of said straps further comprising a connecting means for attaching said straps to a structural support point; and f) an adjusting means which, in combination with said straps and said structural support points, is used to adjust the length of said straps;

whereby said flap may be positioned around a patient's bottom and secured by said straps and said adjusting means.

2. The patient sling of claim 1 further including:

a) a ring attached to the side of said sling through which said strap passes whereby the angle of action of the tension of said strap on said flap may be controlled by the location of said ring.

3. The patient sling of claim 2;

a) wherein said ring has an oval, triangular, trapezoidal or otherwise non-circular shape.

4. The patient sling of claim 1 further including:

a) a ring attached to the side of said sling through which said strap passes whereby the angle of action of the tension of said strap on said flap may be controlled by the location of said ring.

5. The patient sling of claim 4;

a) wherein said ring has an oval, triangular, trapezoidal or otherwise non-circular shape.

6. A method for placing a patient into a support sling, comprising the steps of:

a) providing a substantially u-shaped fabric comprising a horizontal central span and a substantially vertical fabric extending from either side of said central span and substantially perpendicularly to said central span b) providing a flap of fabric extending downwards from said central span and between said vertical fabric c) providing a plurality of connecting means for securing said sling to a lifting and transporting device d) folding said flap of fabric upwards to form a pouch e) sliding said central span of said sling behind the patient's back with said pouch positioned away from said patient f) placing ones hands into said pouch and urging downwards inside said pouch so as to further slide said central span downwards behind said patient's back and unfurl said flap around and under said patient's buttocks whereby said patient may be lifted up and off of a surface for transport securely to another location.

7. The method for placing a patient into a support sling of claim 6, further including the steps of:

a) providing at least one strap attached to said flap and extending outwards from either side of said flap, the ends of said straps further comprising a connecting means for attaching said straps to a structural support point b) securing said flap underneath said patient's buttocks by connecting said strap to a support point using said connecting means c) passing said vertical fabric underneath each thigh of said patient d) providing a plurality of connecting means for securing said sling to a lifting and transporting device e) attaching said sling to said lifting device using said connecting means whereby said patient may be lifted up and off of a surface for transport securely to another location.

8. The method for placing a patient into a support sling of claim 7, further including the steps of:

a) providing an adjusting means which, in combination with said strap and said structural support point, may be used to adjust the length of said strap whereby said sling may be fitted to said patient who then may be lifted up and off of a surface for transport securely to another location.

9. The method for placing a patient into a support sling of claim 7, further including the steps of:

a) providing a ring attached to the side of said sling through which said strap passes whereby the angle of action of the tension of said strap on said flap may be controlled by the location of said ring.

10. The method for placing a patient into a support sling of claim 9 wherein said ring has an oval, triangular, trapezoidal or otherwise non-circular shape.

11. The method for placing a patient into a support sling of claim 8, further including the steps of:

a) providing a ring attached to the side of said sling through which said strap passes whereby the angle of action of the tension of said strap on said flap may be controlled by the location of said ring.

12. The method for placing a patient into a support sling of claim 11 wherein said ring has an oval, triangular, trapezoidal or otherwise non-circular shape.

* * * * *